US006962035B2

(12) United States Patent
Yamamoto et al.

(10) Patent No.: US 6,962,035 B2
(45) Date of Patent: Nov. 8, 2005

(54) BAG MANUFACTURING AND PACKAGING APPARATUS

(75) Inventors: Akira Yamamoto, Ritto (JP); Yoshio Iwasaki, Ritto (JP); Yukio Nakagawa, Ritto (JP); Yasushi Yamaguchi, Kyoto (JP); Tatsuo Ito, Kyoto (JP)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 10/695,912

(22) Filed: Oct. 30, 2003

(65) Prior Publication Data

US 2004/0088948 A1 May 13, 2004

(30) Foreign Application Priority Data

Nov. 1, 2002 (JP) ..... 2002-320299

(51) Int. Cl.[7] ..... B65B 61/00
(52) U.S. Cl. ..... 53/135.1
(58) Field of Search ..... 53/135.1, 531, 53/591, 136

(56) References Cited

U.S. PATENT DOCUMENTS 3,864,895 A 2/1975 Petrea
5,433,060 A 7/1995 Gur et al.

*Primary Examiner*—John Paradiso
(74) *Attorney, Agent, or Firm*—Shinjyu Global IP Counselors, LLP

(57) ABSTRACT

A bag manufacturing and packaging apparatus includes a bag manufacturing unit that tubularly forms a strip film and manufactures a bag filled with articles; a feed roller unit that feeds a strip, to which the bag manufactured by the bag manufacturing unit is mounted; and a mounting unit that mounts the bag to the strip fed by the feed roller unit. The strip is rectilinearly maintained between the feed roller unit and the mounting unit by imparting a bend on the strip in the transverse cross section that intersects a transport pathway of the strip. The object of the present invention is to provide a bag manufacturing and packaging apparatus that, even if the strip to which bags are mounted lacks rigidity, can smoothly feed the strip, automatically thread the strip to the mounting unit, and form appropriate slits in the strip.

18 Claims, 9 Drawing Sheets

BAG MANUFACTURING AND PACKAGING APPARATUS

BACKGROUND OF THE INVENTION

1. Field of the Invention

This invention generally relates to a bag manufacturing and packaging apparatus. More specifically, the present invention relates to a bag manufacturing and packaging apparatus that forms a strip film into a tubular shape, manufactures bags filled with articles, and mounts those bags to a strip narrower than the bags.

2. Background Information

In one mode of displaying articles in a retail store, a plurality of bags in which articles like snacks and candies are filled and packaged, are attached to a strip for displaying the articles, leaving a small gap between each bag. This way, the bags are arranged vertically by hanging the end of the strip. A suspended bag can be removed from the strip by a customer without damaging the seal of the bag by pulling the bag downward and thereby detaching the bag. To manufacture such an apparatus, it has been suggested to impart to a bag manufacturing and packaging apparatus a function that mounts manufactured bags to a strip. Examples of such bag manufacturing and packaging apparatus are shown in Japanese translation of PCT Application Publication 9-508879, U.S. Pat. No. 3,864,895, and PCT International Application Publication 98/52823.

Further, as recited in Japanese Patent Application No. 2002-251845, the assignee company of the present applicant has proposed a bag manufacturing and packaging apparatus including: a bag manufacturing unit 10 that forms a strip film F into a tubular form and manufactures a bag B filled with articles C; a feed roller unit (drive roller 41*c*) that feeds a strip S, which is narrower than the bags B and to which bags B manufactured by the bag manufacturing unit 10 are mounted; and a strip mounting unit 30 that mounts the bags B to the strip S fed by the feed roller unit.

Incidentally, as depicted in FIG. 8 of Japanese Patent Application No. 2002-251845, the feed roller unit is arranged spaced apart by a certain amount from the strip mounting unit 30 in order to avoid interfering with the strip mounting unit 30 or a transfer mechanism 32, which transports bags B from the bag manufacturing unit 10 to the strip mounting unit 30. If the strip S is formed from a stiff material, such as coated paper, or formed with a thickness greater than or equal to a prescribed thickness, then the strip S fed from the feed roller unit is fed smoothly as far as the strip mounting unit 30, without sagging downward.

Nevertheless, if the strip S is formed from a material such as a thin resin that lacks rigidity, then the strip S will unfavorably sag downward between the feed roller unit and the strip mounting unit 30, and may not feed smoothly. Accordingly, problems such as jamming of the strip S in the guide unit 49 (discussed later) and the like may arise, and unevenness in the mounting gap of the bags B on the strip S may result.

In addition, the above-mentioned bag manufacturing and packaging apparatus is constituted so that a cutter 45 between the feed roller unit and the strip mounting unit 30 operates and forms slits in the strip S so that the strip S, to which bags B are mounted, can be cut in the retail store into lengths appropriate to display the articles. At that time, it is necessary to apply tension to the Strip S and hold it so that the Strip S does not escape from the cutter 45. However, since the strip S is merely held by the feed roller unit, tension cannot be applied to the strip S when forming a slit.

Furthermore, in the strip mounting unit 30, because bags B are pressed (thermally welded) to the strip S by a pressing body 33*c* on a heater 33*a*, the strip S is held by the feed roller unit and the pressing body 33*c*, such that tension can be applied to the strip S. However, the pressing time is set extremely short so that the heat does not burn through the strip S. Accordingly, it is difficult to adjust the timing at which the cutter 45 should be operated, because there is limited timing for the operation of the cutter 45. Therefore, the guide unit is provided at the perimeter of the cutter 45, which guides the strip S in the transport direction and also ensures that the strip S does not escape from the cutter 45.

Nevertheless, if the strip S is formed from a thin resin that lacks rigidity, and if slits are formed in a state wherein tension is not applied to the strip S, then slits cannot be formed by just sliding the strip S over the cutter. Furthermore, because the guide unit merely planarly guides the strip S only on its upper and lower surfaces, the strip S may drift in the transverse direction in the guide unit, and may not be fed smoothly. As a result, the strip S may get caught in and jammed by the guide unit. As a result, slits may not be accurately formed in the strip S, and the strip S may develop wrinkles, degrading its appearance.

Furthermore, when initially setting the strip S or if, instead of forming slits as described above, the strip S is completely cut, then it will be necessary to thread the strip S by hand from the feed roller unit up to the strip mounting unit 30, making it unamenable to automation.

In view of the above, there exists a need for a bag manufacturing and packaging apparatus which overcomes the above mentioned problems in the prior art. This invention addresses this need in the prior art as well as other needs, which will become apparent to those skilled in the art from this disclosure.

SUMMARY OF THE INVENTION

A purpose of the present invention is to provide a bag manufacturing and packaging apparatus that can smoothly feed a strip even when the strip to which bags are mounted lacks rigidity, automatically set the strip up to the mounting unit, and form appropriate slits in the strip.

The invention of the first aspect of the present invention provides a bag manufacturing and packaging apparatus, having a bag manufacturing unit that manufactures a bag filled with articles; a feed roller unit that feeds a strip, narrower than the bag, to which the bag manufactured by the bag manufacturing unit is mounted; and a mounting unit that receives the bag from the bag manufacturing unit and the strip fed by the feed roller, and mounts the bag to the strip fed by the feed roller unit. The strip is rectilinearly maintained between the feed roller unit and the mounting unit.

According to the first aspect of the present invention, because a strip is rectilinearly maintained by imparting a bend to the strip in the transverse cross section, the strip is smoothly fed from the feed roller unit to the mounting unit without the strip sagging downward or undulating midway. Thereby, it is possible to reliably prevent problems such as jamming of the strip in the transport pathway of the guide unit and the like, unevenness in the gap between the bags mounted to the strip, failures in the positioning and the shape of slits formed in the strip, and wrinkling of the strip.

The second aspect of the present invention provides the bag manufacturing and packaging apparatus as recited in the first aspect, wherein the bend imparted in the transverse cross section of the strip is a curvature.

The second aspect of the present invention achieves the following operational effects by expanding on the invention of the first aspect. Because the bend imparted to the strip is curved, a bend mark is not created in the strip, or the bend mark can be made extremely inconspicuous. In addition, because the mounting unit easily welds the weld surfaces of the strip and the bag, bags are reliably mounted.

The third aspect of the present invention provides the bag manufacturing and packaging apparatus as recited in the first aspect, wherein the bend is formed upwardly convex.

The third aspect of the present invention achieves the following operational effects by expanding on the invention of the first aspect. Because the bend imparted to the strip is formed upwardly convex, the strip spreads so that it follows the mounting unit by the weight of the strip itself, and smoothly hangs downward on the downstream side of the mounting unit. Thereby, wrinkling of the strip is prevented, the welded surfaces of the strip and the bag are significantly more easily welded, and the bags are thereby more reliably mounted.

The fourth aspect of the present invention provides the bag manufacturing and packaging apparatus as recited in any one of the first through third aspects, wherein a bend is imparted in the transverse cross section of the strip by forming the transverse cross section of the transport pathway into a curved shape in the feed roller unit.

The fourth aspect of the present invention achieves the following operational effects by expanding on the invention of any one of the first through third aspects. Because the feed roller unit imparts a bend in the transverse cross section of the strip, the manufacturing cost of the apparatus itself can be reduced and the problem of competing space requirements can be avoided without the need to add dedicated parts only for the purpose of imparting a bend.

The fifth aspect of the present invention provides the bag manufacturing and packaging apparatus as recited in the fourth aspect, wherein the feed roller unit includes a drive roller and a pressing roller that mates with the drive roller via their rotary surfaces; one of the rotary surfaces of the drive roller and the pressing roller has a convex surface; and the other of the rotary surfaces has a concave surface corresponding to the convex surface.

The fifth aspect of the present invention achieves the following operational effects by expanding on the invention of the fourth aspect. The rollers having the convex surface and the concave surface can be easily manufactured by machining and the like, and the manufacturing cost of the apparatus itself can thereby be held down.

The sixth aspect of the present invention provides the bag manufacturing and packaging apparatus as recited in the fifth aspect, wherein a rubber roller part is provided in a center part of the convex surface.

The sixth aspect of the present invention achieves the following operational effects by expanding on the fifth aspect. The rubber roller part provided in the center part of the convex surface presses the strip against the center part of the corresponding concave surface. Thereby, the strip can be reliably fed by the roller while preventing problems such as the tendency to impart a bend mark to the strip, or damaging the strip.

The seventh aspect of the present invention provides the bag manufacturing and packaging apparatus as recited in any of the first through sixth aspects, wherein a guide unit through which the strip is made to pass is provided and arranged on the transport pathway of the strip between the feed roller unit and the mounting unit; and a transverse cross section of the transport pathway of the strip in the guide unit is formed into a bent shape, such that the guide unit imparts the bend in the transverse cross section of the strip.

The seventh aspect of the present invention achieves the following operational effects by expanding on the invention of any of the first through sixth aspects. Because the guide unit imparts a bend to the strip between the feed roller unit and the mounting unit, the strip can be reliably maintained rectilinearly in the guide unit, and before and after the strip passes through the guide unit.

The eighth aspect of the present invention provides the bag manufacturing and packaging apparatus as recited in the seventh aspect, wherein a cutter is provided and arranged that, midway in the guide unit, forms a slit in a direction approximately orthogonal to the direction of the transport pathway of the strip.

The eighth aspect of the present invention achieves the following operational effects by expanding on the invention of the seventh aspect. Because there is a guide unit, wherein a bend is formed in a direction so that the strip does not attempt to escape from the cutters, and the guide unit supports the strip while imparting a bend to the strip, the escape of the strip from the cutter is prevented. Thereby, appropriate slits can be reliably formed in the strip.

The ninth aspect of the present invention provides the bag manufacturing and packaging apparatus as recited in the eight aspect, wherein the cutter forms a slit at the vicinity of the apex of the bend imparted to the transverse cross section of the strip, and the cutter passes through the strip from the concave surface side of the bend to the convex surface side.

The ninth aspect of the present invention achieves the following operational effects by expanding on the eight aspect. Because the cutters are made to pass through the strip from the concave surface side in the vicinity of the apex of the bend of the strip, the escape of the strip from the cutter due to the pressing of the strip by the cutter is prevented. Thereby, appropriate slits can be formed more reliably.

The tenth aspect of the present invention provides the bag manufacturing and packaging apparatus as recited in any of the seventh through ninth aspects, wherein the guide unit has a convex part that extends in the transport direction of the strip, and a concave part that faces opposite the convex part and accommodates the convex part; and passes through the strip in the gap between the convex part and the concave part.

The tenth aspect of the present invention achieves the following operational effects by expanding on the invention of any of the seventh through ninth aspects. Because the guide unit is formed by fabricating the convex part and the concave part separately and then combining them, it is easy to manufacture the bend shape in the transport pathway. Thereby, the manufacturing cost of the apparatus itself can be held down.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following description of the embodiments of the present invention is provided for illustration only, and not for the purpose of limiting the invention as defined by the appended claims and their equivalents.

Figure 1:
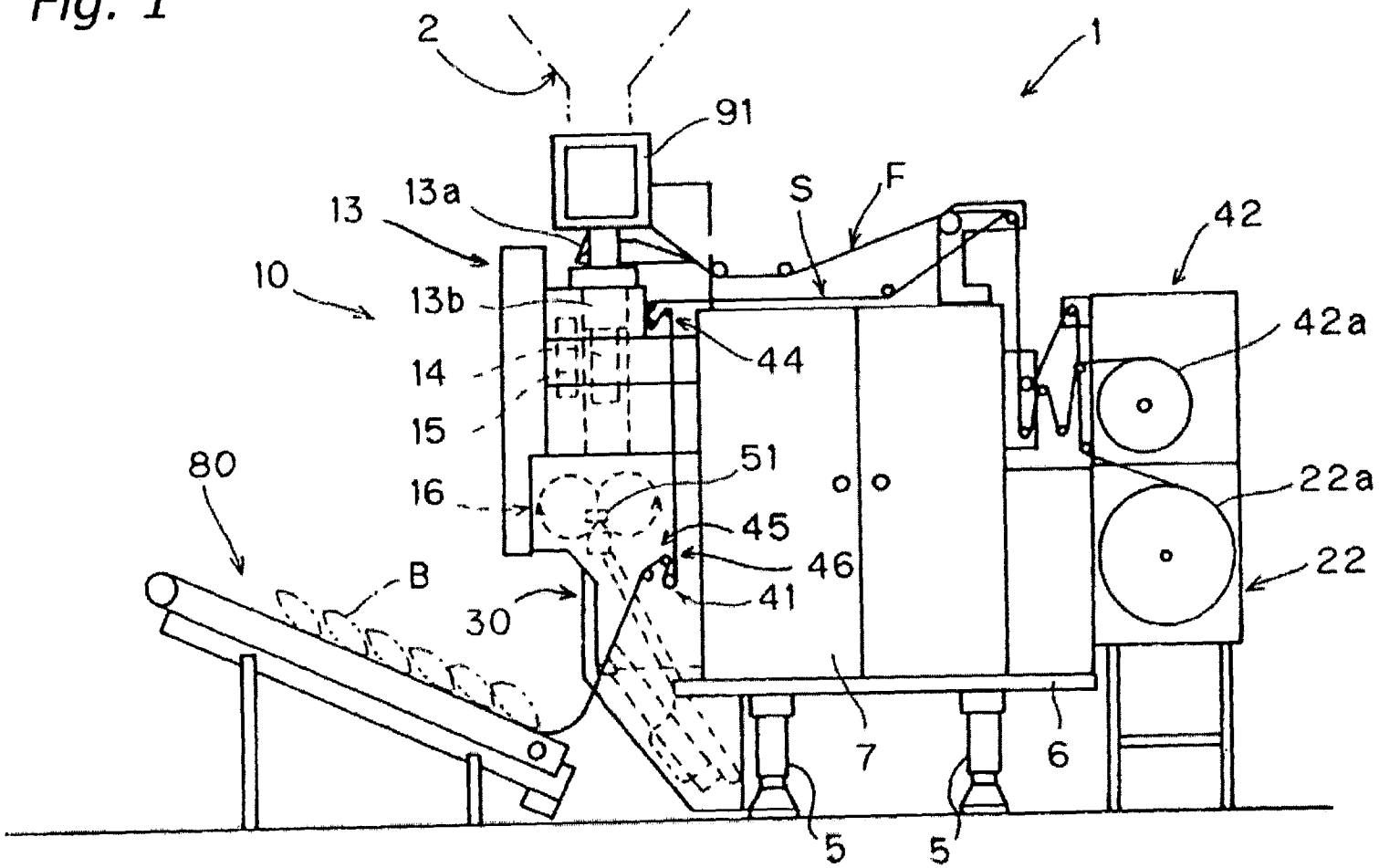
FIG. 1 is a side view of the entirety of the bag manufacturing and packaging apparatus according to the embodiment of the present invention.
Figure 2:
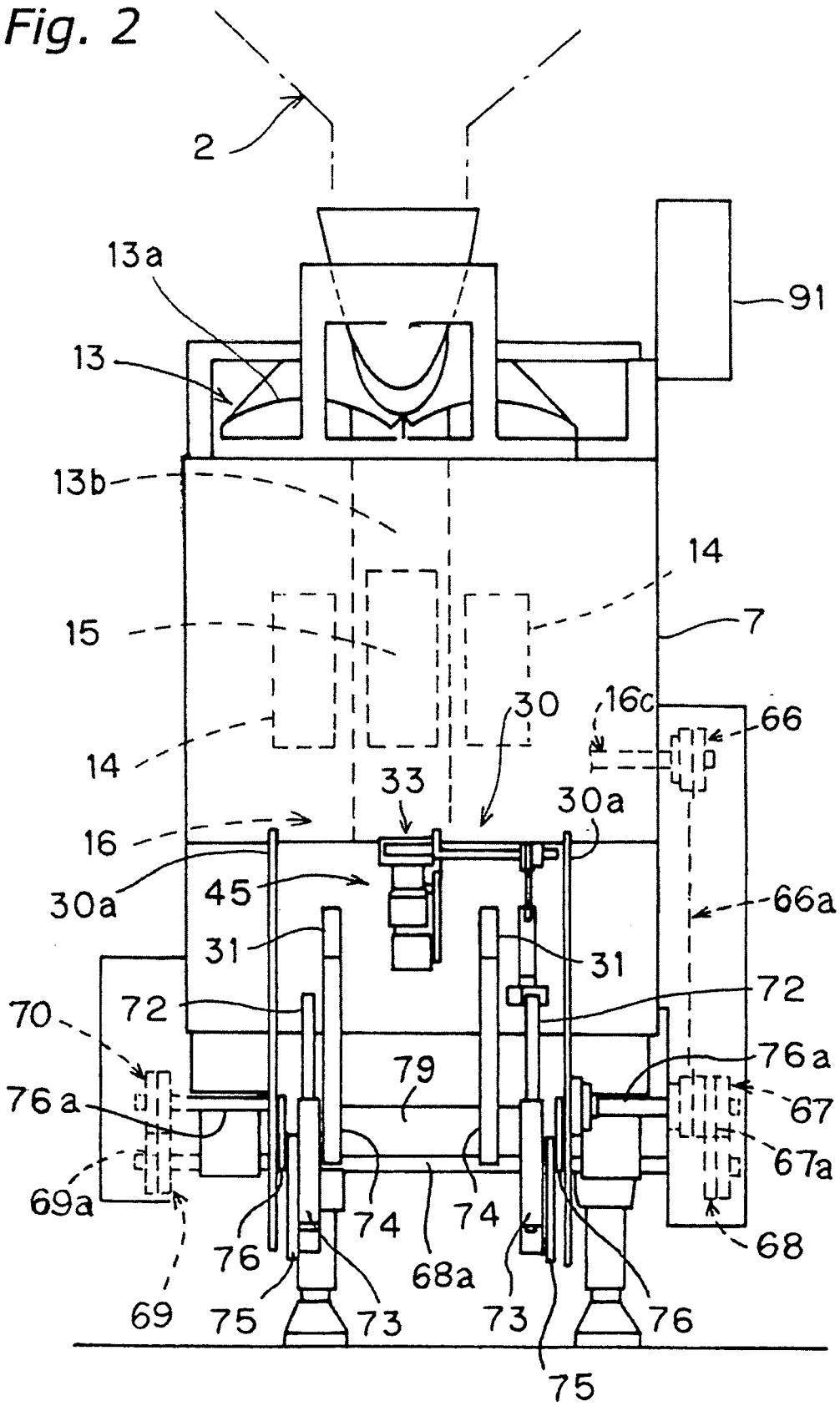
FIG. 2 is a front view of the entirety of the bag manufacturing and packaging apparatus according to the embodiment of the present invention.
Figure 9:
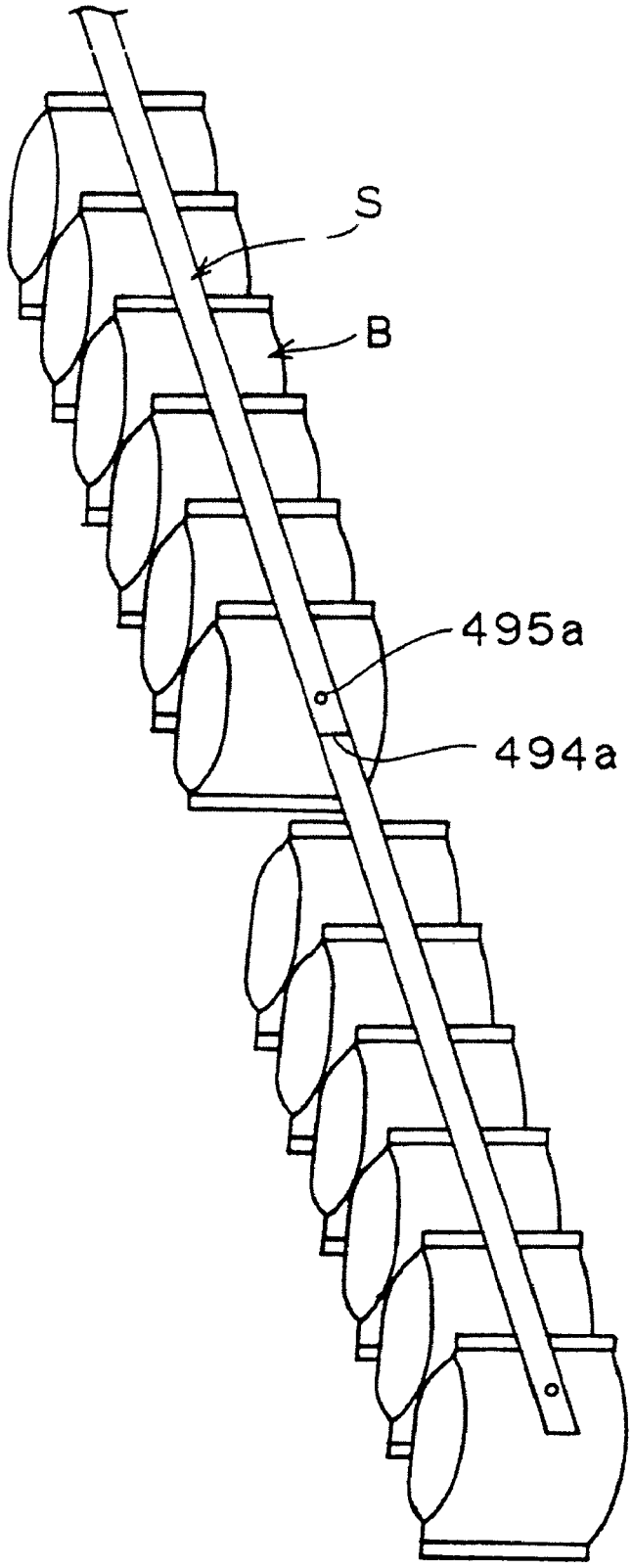
FIG. 9 is a view of bags that are mounted to the strip.

The following explains embodiments of the present invention, referring to the drawings. FIG. 1 is a side view of the entirety of a vertical bag manufacturing and packaging apparatus 1 according to one embodiment of the present invention, and FIG. 2 is its front view. The bag manufacturing and packaging apparatus 1 principally includes a bag manufacturing unit 10, a film roll holding unit 22, a strip mounting unit 30, a strip transport unit 41, a strip roll holding unit 42, a bend-imparting unit 45, a transport conveyor 80, and a control unit 90. The portion of the bag manufacturing and packaging apparatus 1 other than the transport conveyor 80 is supported by a frame 6 supported by support legs 5, and is entirely enclosed by a safety cover 7. The present bag manufacturing and packaging apparatus 1 manufactures a bag B filled with articles by forming a strip film F into a tubular shape, sealing the lower end and side of the tubular bags, dropping therein snacks and candies and the like (articles) of a prescribed weight weighed by a weigher 2, and sealing the upper end of the bags B. The strip mounting unit 30 successively thermally welds the manufactured bags B to the strip S that is reeled out from a strip roll 42*a*. Further, as shown in FIG. 9, a plurality of bags B is mounted to the strip S so that they are arranged at prescribed intervals.

Bag Manufacturing Unit 10

As shown in FIG. 1 and FIG. 2, the bag manufacturing unit 10 includes a forming mechanism 13, pull-down belt mechanisms 14, a longitudinal sealing mechanism 15, and a transverse sealing mechanism 16. The bag manufacturing unit 10 forms a strip film F into a tubular shape, fills articles therein, and thereby manufactures bags filled with articles.

The forming mechanism 13 has a former 13*a* and a tube 13*b*. The forming mechanism 13 first sends to the former 13*a* the strip film F paid out from a film roll 22*a* of the film roll holding unit 22. The former 13*a* is provided and arranged so that it encircles the cylindrical tube 13*b*, which is open at the upper and lower ends. The strip film F sent to the former 13*a* is formed into a tubular shape by wrapping the strip film F around the tube 13*b*. Furthermore, the weigher 2 is provided and arranged above the upper end opening of the tube 13*b* so that a prescribed weight of articles are weighed out and dropped through the tube 13*b*, thereby filling articles in the tubularly formed film (hereinafter, the tubular film).

The pull-down belt mechanisms 14 are provided and arranged so that suction belts, having a sucking function, grab the left and right sides of the tube 13*b*. In the pull-down belt mechanisms 14, the suction belts draw the tubular film that encircles the tube 13*b*. The drive rollers rotate the suction belts, thereby transporting the tubular film downward.

The longitudinal sealing mechanism 15 has a heater belt that is heated by a heater. The heater belt is provided and arranged in front of the tube 13*b*, and seals the tubular film in a longitudinal direction by welding while pressing to the tube 13*b* the overlapping part of the sides of the tubular film that encircles the tube 13*b*.

Figure 3:
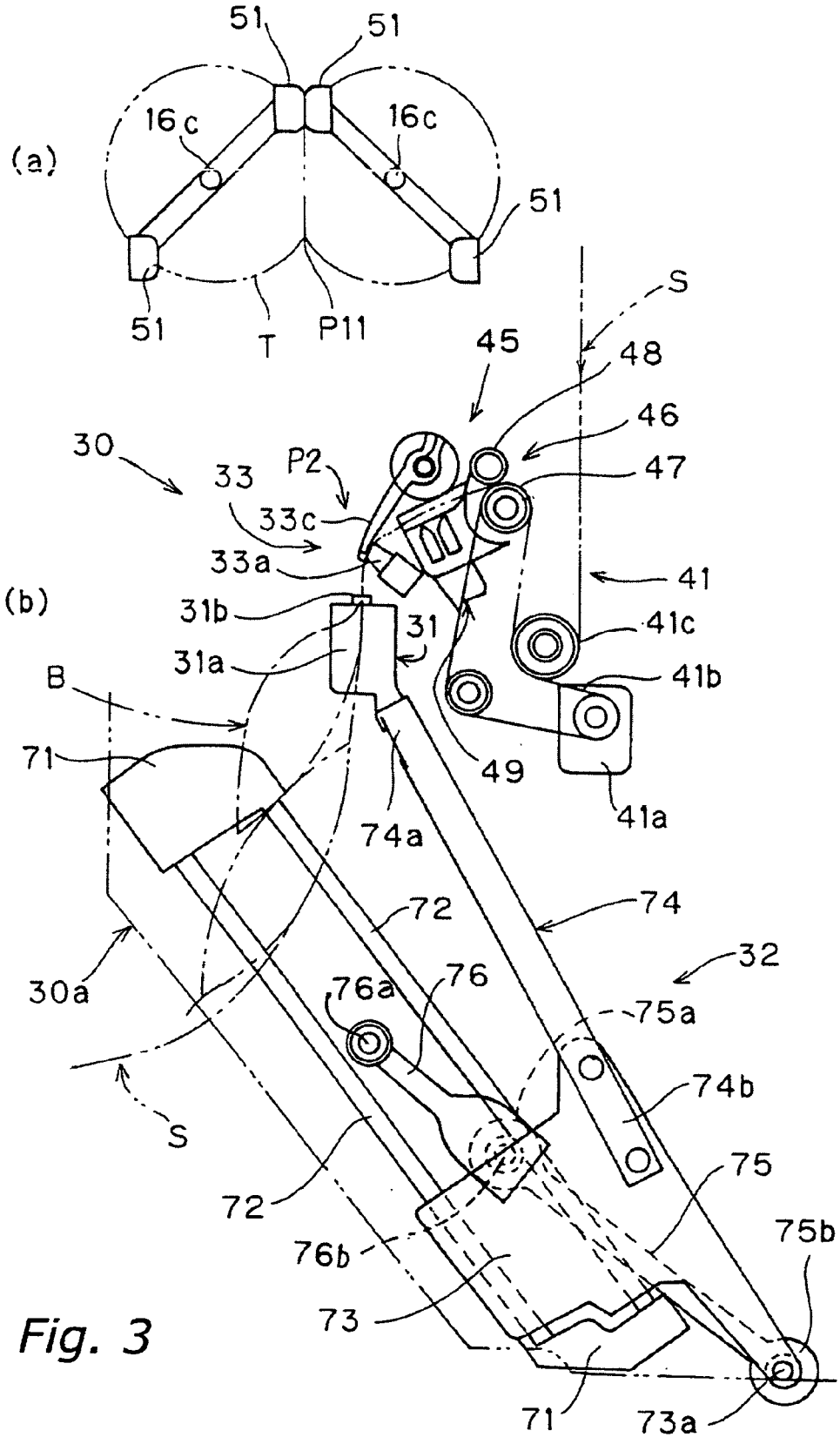
FIG. 3(*a*) is a side schematic diagram of the transverse sealing mechanism, and FIG. 3(*b*) is a side schematic diagram of the strip transport unit, the strip mounting unit, and the bend-imparting unit according to the embodiment of the present invention.

The transverse sealing mechanism 16 is provided and arranged below the longitudinal sealing mechanism 15, and has sealing jaws 51 that are heated by a heater. The sealing jaws 51 are arranged in front of and behind the tubular film, are supported by shafts 16*c*, as shown in FIG. 3(*a*), and respectively revolve around the shafts 16*c* with front-rear symmetry so that they define a D-shaped trajectory T.

A rotary motor 16*a* rotates the shafts 16*c*, and a shaft transfer motor 16*b* reciprocates the shafts 16*c* frontward and rearward. This reciprocating motion adjusts the distance between the shafts 16*c* to implement the rectilinear portion of the D-shaped trajectory T. The portions corresponding to the upper and lower ends of the bag B are welded and transversely sealed by the front-rear pair of sealing jaws 51 pinching the tubular film from the front and rear at the upper end of the rectilinear portion of the trajectory T. Furthermore, after the front-rear pair of sealing jaws 51 moves downward with the tubular film pinched therebetween from the front and rear, the front-rear pair of sealing jaws 51 mutually separates at a point P11 at the lower end side of the overlapping portion of the trajectory T, thereby releasing the pinched tubular film.

Furthermore, cutters (not shown) are attached to the sealing jaws 51, and, at the center part of the transverse seal unit in the vertical direction, these cutters cut the tubular film in the horizontal direction. Thereby, the upper end of the manufactured bag B, and the lower end of the tubular film continuing therefrom, are transversely sealed and, at the same time, cut and vertically separated. Thereafter, the bag B is discharged downward at the point P11 shown in FIG. 3(*a*).

The bag manufacturing unit 10 is a conventional component that is well known in the art. Since the bag manufacturing unit 10 is well known in the art, its structure will not be discussed or illustrated in further detail herein.

Film Roll Holding Unit 22

The film roll holding unit 22 holds the film roll 22*a* around which the strip film F, supplied to the bag manufacturing unit 10, is wrapped. To prevent the strip film F from slackening and meandering in the space from the film roll 22*a* until it is supplied to the bag manufacturing unit 10, a dancer roller provided and arranged above the transport pathway applies an appropriate amount of tension. A film remaining amount sensor 23 is provided and arranged in the vicinity of the film roll holding unit 22 for detecting the amount of strip film F remaining. The remaining amount sensor 23 is a conventional component that is well known in the art. Since the remaining amount sensor 23 is well known in the art, its structure will not be discussed or illustrated in further detail herein.

Strip Mounting Unit 30

Figure 4:
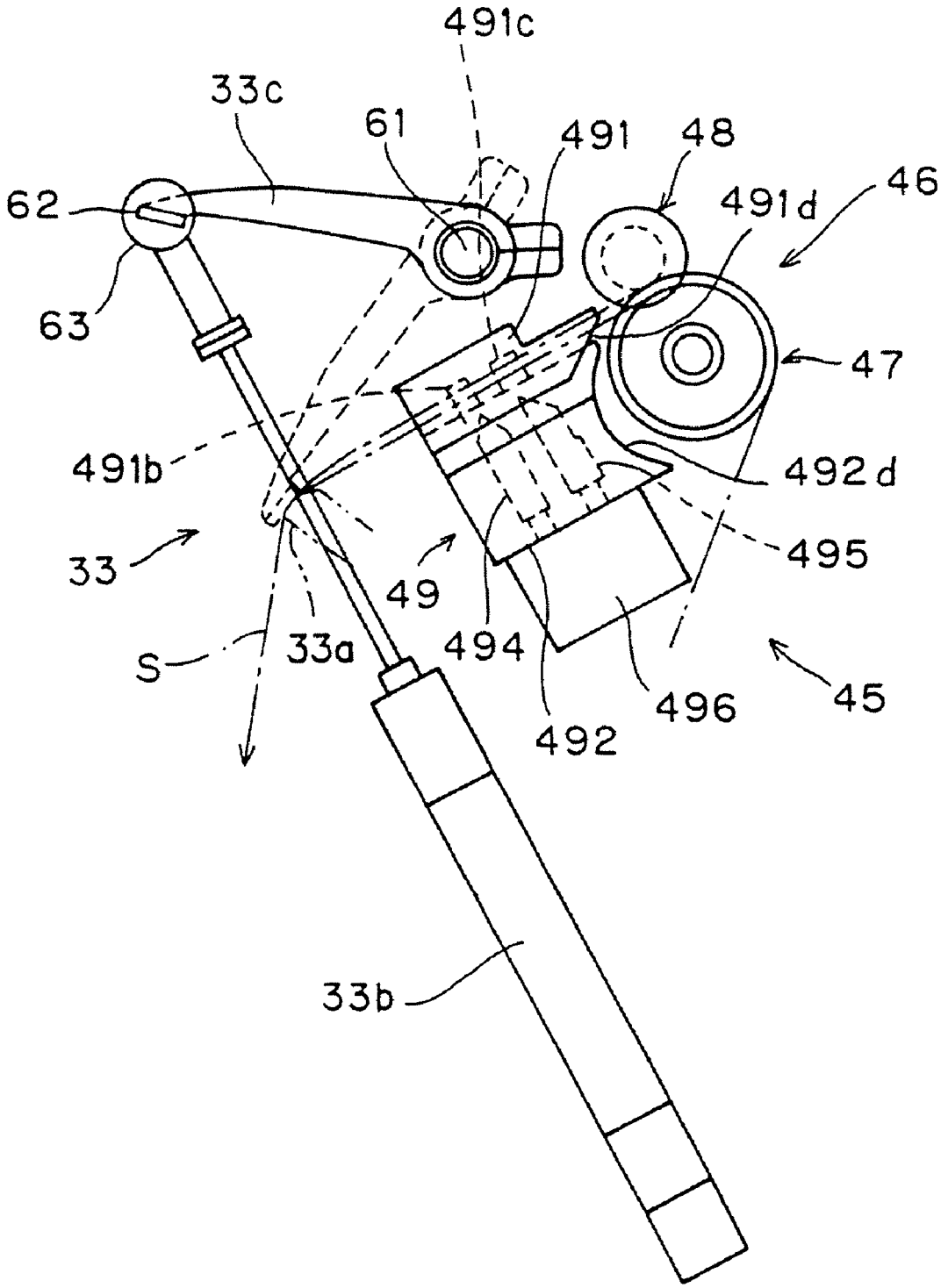
FIG. 4 is a side view of the bend-imparting unit and the strip mounting unit according to the embodiment of the present invention.
Figure 5:
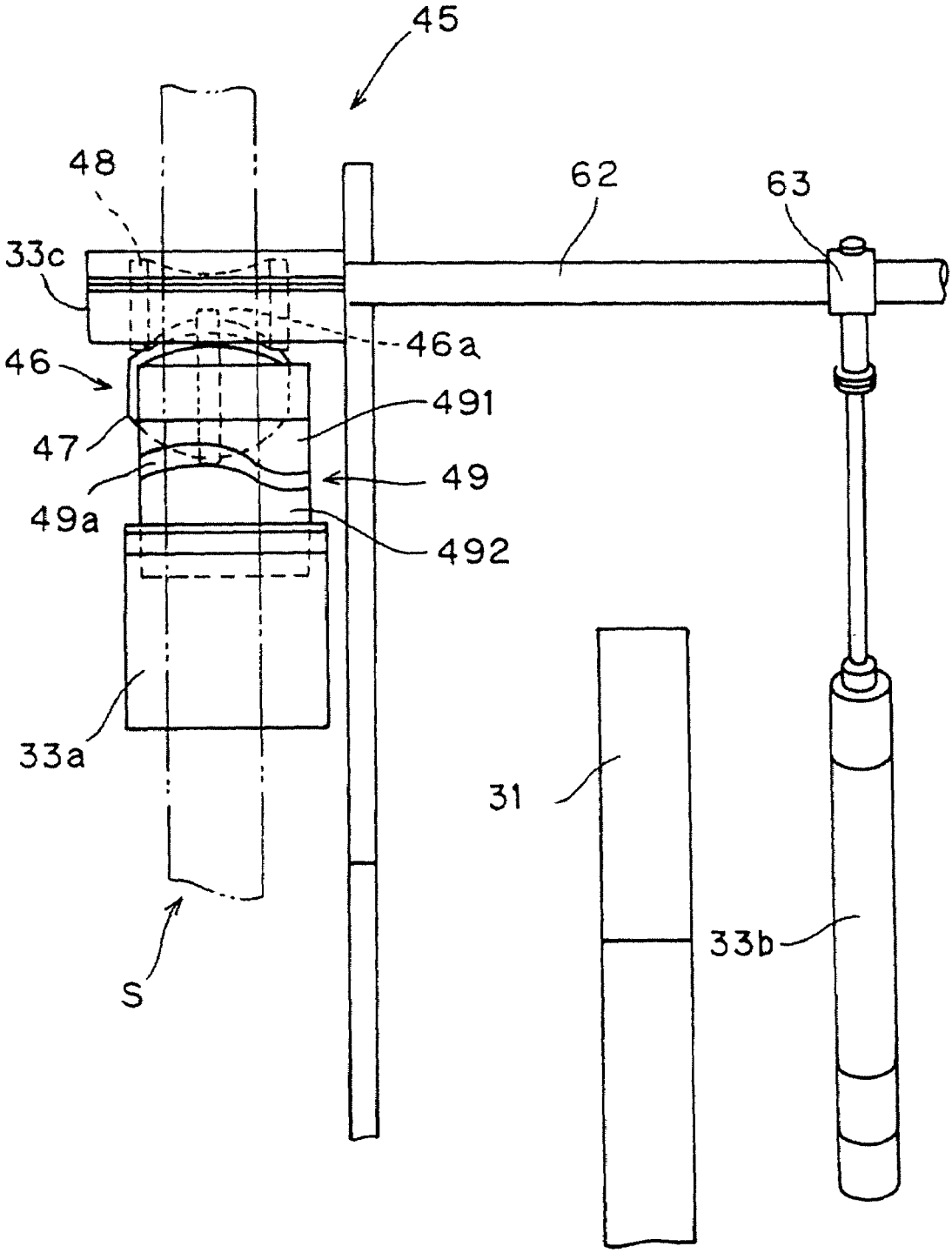
FIG. 5 is a front view of the bend-imparting unit and the strip mounting unit according to the embodiment of the present invention.

As shown in FIG. 3(*a*), FIG. 3(*b*), FIG. 4, and FIG. 5, the strip mounting unit 30 is disposed underneath the bag manufacturing unit 10 and has holding mechanisms 31, the transfer mechanism 32, and a fixing mechanism 33. In the strip mounting unit 30, the holding mechanisms 31 hold at the point P11 the bag B discharged from the bag manufacturing unit 10, the transfer mechanism 32 transfers the bag B diagonally downward, and then the fixing mechanism 33 mounts the bag B onto the strip S.

Each holding mechanism 31 has a main body 31*a*, a grasping unit 31*b* provided and arranged on the main body 31*a*, and a fixed part for fixing the holding mechanism 31 to the transfer mechanism 32. The grasping unit 31*b* includes a grasping arm, which is attached to the top side part of the main body 31*a*. An air cylinder (not shown) built into the main body 31*a* drives the grasping arm open and closed. A pair of holding mechanisms 31 is arranged, one each on the left and right sides of the fixing mechanism 33, as shown in FIG. 2. The grasping units 31*b* simultaneously grasp both the left and right sides of the bag B in a state immediately before being released from the sealing jaws 51 at the point P11.

The transfer mechanism 32 reciprocates the holding mechanisms 31 between the point P11, where the bag B is received from the sealing jaws 51, and a fixing point P2, where the bag B is attached to the strip S. The transfer mechanism 32 has rails 72, which are fixedly held at the upper and lower ends by fixed members 71; sliding members 73, which are slidably supported by the rails 72; arms 74, which are fixedly held at the lower end by the sliding members 73; linking members 75, which are attached to the sliding members 73 so as to be freely rotatable; and rotary members 76, which are linked freely rotatably at one end to the linking members 75 and supported at the other end by rotary shafts 76*a*. Furthermore, each of the abovementioned members 71–76 is a left-right pair, as shown in FIG. 2.

The fixed members 71 are fixedly held to a left-right pair of sidewall plates 30*a*, which are attached to the frame 6 so as to cover the strip mounting unit 30 from the sides. The sliding members 73 are supported freely slidable so that they do not move while they are in the inclined state, and so that they reciprocate on the fixed rails 72. A connecting member 79 links the left-right pair of members. The sliding members 73 are fixedly held so that the left-right pair of arms 74 extends diagonally upward via the connecting member 79. The left-right pair of holding mechanisms 31 is fixedly held to upper end parts 74*a* of the left-right pair of arms 74.

One end parts 75*b* of the linking members 75 are attached freely rotatably to lower end parts 73*a* of the sliding members 73. Further, other end parts 75*a* of the linking members 75 are linked freely rotatably to rotary end parts 76*b* of the rotary members 76. Accordingly, by rotating the rotary shafts 76*a*, which support the rotary members 76, the linking members 75 vertically reciprocate the sliding members 73 on the rails 72.

A pulley 67 and a pulley 70 are respectively attached to the left-right pair of the rotary shafts 76*a*. The pulley 67 is linked to the shaft 16*c* via a belt 66*a* and a pulley 66 provided at one end of the shaft 16*c*, which rotates the sealing jaws 51. In addition, the pulley 67 is linked to the pulley 70 via a belt 67*a*, a pulley 68, a linking shaft 68*a*, a pulley 69, and a belt 69*a*. In other words, the left-right pair of rotary shafts 76*a* to which the pulley 67 and the pulley 70 are attached, is both linked to the shaft 16*c*. Consequently, the sliding members 73, which are linked to the rotary shafts 76*a* via the rotary members 76 and the linking members 75; and the sealing jaws 51 of the transverse sealing mechanism 16, which are rotatably driven by the shafts 16*c*, are mechanically interlocked.

Based on the above, the bag manufacturing and packaging apparatus 1 of the present invention can be constituted so that the holding mechanisms 31 move below the sealing jaws 51 immediately before the bag B manufactured by the bag manufacturing unit 10 is discharged downward, grasps both the left and right sides of the bag B, transports the bag B as far as the fixing mechanism 33. Then, the holding mechanism 31 once again moves to below the sealing jaws 51 by the time the following bag B is discharged.

The fixing mechanism 33 has the heater 33*a*, a pressing cylinder 33*b*, and the pressing body 33*c*. The heater 33*a* is the heat source for attaching to the strip S the bag B transported by the holding mechanisms 31. The heater 33*a* is normally energized during operation of the bag manufacturing and packaging apparatus 1, and maintains a high maximum temperature of 200° C. The pressing cylinder 33*b* reciprocates a drive rod by high-pressure air supplied from a compressor (not shown). The pressing cylinder 33*b* is linked to the tip part of the pressing body 33*c*, which is supported by a linking member 62, via a head 63 that is attached to the tip part of the drive rod. Because the base end part of the pressing body 33*c* is rotatably supported by a fixed shaft 61, the pressing body 33*c* vertically reciprocates, as shown in FIG. 4, by pivoting attendant with the reciprocating motion of the pressing cylinder 33*b*, which his linked to the tip part of the pressing body 33*c*. When the pressing body 33*c* pivots downward, the strip S and the upper end part of the manufactured bag B are interposed by the pressing body 33*c* and the heater 33*a*, and the upper end part of the bag B is thereby attached to the strip S. Furthermore, the amount of time that the pressing body 33*c* presses against the heater 33*a* is set to an extremely short time of approximately 200 ms, so that the heat of the heater 33*a* does not burn through the strip S.

The strip mounting unit 30 is a conventional component that is well known in the art. Since the strip mounting unit 30 is well known in the art, its structure will not be discussed or illustrated in further detail herein.

Strip Roll Holding Unit 42

The strip roll holding unit 42 holds the strip roll 42*a*, around which the supplied strip S is wrapped, and supplies the strip S between the heater 33*a* and the pressing body 33*c* of the fixing mechanism 33 as shown in FIG. 1. The strip S is a thin, unrigid tape formed from resin, and its width is set narrower than the bag B manufactured by the bag manufacturing unit 10. To prevent the strip S from slackening and meandering between the strip roll 42*a* and a feed roller unit 46, a dancer roller and the like provided and arranged above the transport pathway applies appropriate tension to the strip S. To detect the amount of strip S remaining, a strip remaining amount sensor 43, which includes a photoelectric sensor, is provided and arranged in the vicinity of the strip roll holding unit 42.

Strip Transport Unit 41

The strip transport unit 41 is disposed adjacent to the strip mounting unit 30 and transports the strip S reeled out from the strip roll 42*a* to the fixing mechanism 33, as depicted in FIG. 3(*b*). The strip transport unit 41 has a transport motor 41*a*, a drive belt 41*b*, the drive roller 41*c*, a drive roller 47, as well as numerous other rollers. The drive belt 41*b* is threaded around the rotary shaft pulley of the transport motor 41*a*, the drive roller 41*c*, and the pulley attached to the drive roller 47. When the transport motor 41*a* is rotated, the rotation is transmitted to the drive roller 41*c* and the drive roller 47 via the drive belt 41*b*. The strip S wraps around the drive roller 41*c* and the drive roller 47, and is fed from the feed roller unit 46 (discussed later), which includes the drive roller 47 and a pressing roller 48, to between the heater 33*a* and the pressing body 33*c* of the fixing mechanism 33 of the strip mounting unit 30. The feed roller unit 46 is arranged at a certain distance from the strip mounting unit 30 so as to avoid interfering with the strip mounting unit 30 and the transfer mechanism 32, which transfers the bag B from the bag manufacturing unit 10 to the strip mounting unit 30.

The transport motor 41*a* is a servomotor. The control unit 90 controls the feed rate of the strip S based on pulses from the transport motor 41*a*. A tension control mechanism 44, having a so-called dancer roller, is provided in the transport pathway of the strip S that between the strip roll 42*a* of the strip roll holding unit 42 from which the strip S is reeled out and the fixing mechanism 33 of the strip mounting unit 30. The tension control mechanism 44 is constituted so that the strip S does not slacken or meander. As shown in FIG. 1, the tension control mechanism 44 is arranged on the upstream side of the feed roller unit 46 in the transport pathway of the strip S. Therefore, the tension control mechanism 44 does not affect the strip S reeled out from the feed roller unit 46 toward the downstream side.

Figure 6:
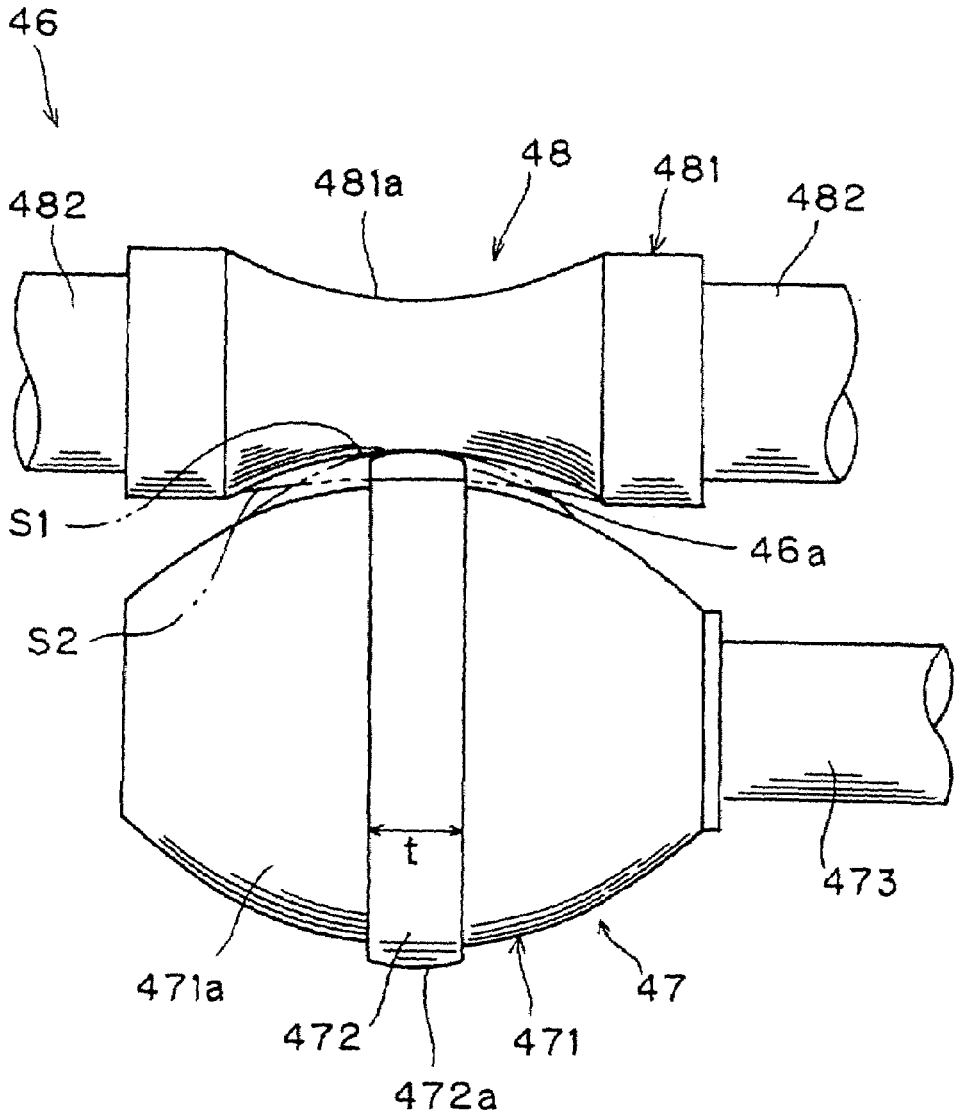
FIG. 6 is an enlarged view of the feed roller according to the embodiment of the present invention.
Figure 7:
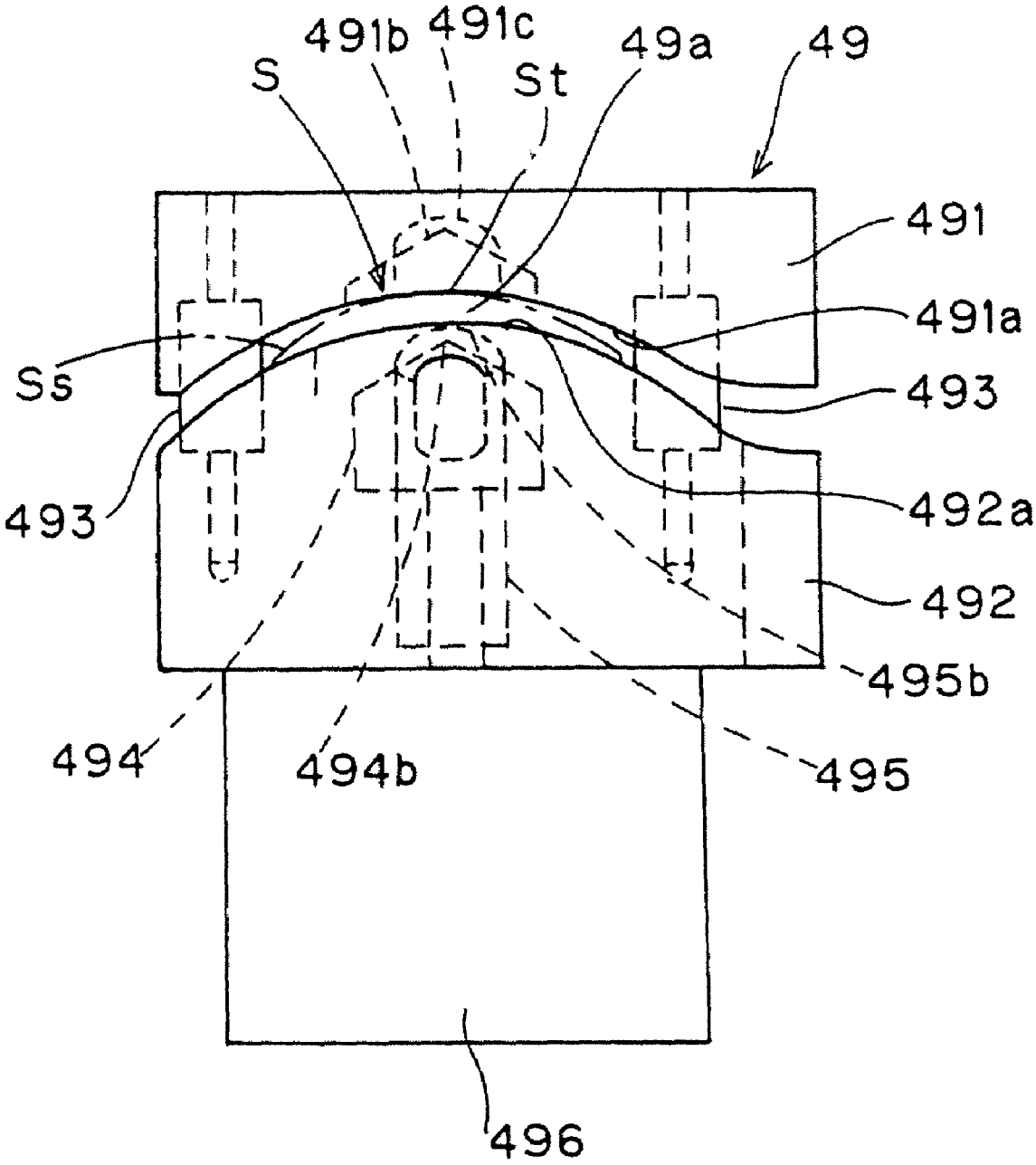
FIG. 7 is an enlarged view of the guide unit according to the embodiment of the present invention.

By imparting a bend to the strip S in the transverse cross section that intersects the transport pathway of the strip S, as shown in FIG. 4, FIG. 6, and FIG. 7, the bend-imparting unit 45 forcibly maintains the strip S rectilinearly between the feed roller unit 46 and the fixing mechanism 33, i.e., the strip mounting unit 30. The bend-imparting unit 45 is arranged on the upstream side of the strip mounting unit 30 in the transport pathway of the strip S, and includes the feed roller unit 46 and a guide unit 49.

The feed roller unit 46 includes a combination roller including the drive roller 47, which is a convex roller, and the pressing roller 48, which is a concave roller as shown in FIG. 6. In the drive roller 47, the main body 471 has an approximately rugby ball-shaped convex surface 471*a* on its rotary surface. The convex surface 471*a* is manufactured by machining on a lathe. A rubber roller part 472 is provided in the center part of the convex surface 471*a*. The rubber roller part 472 is formed by mating a ring-shaped rubber band to a ring-shaped groove (not shown) formed in the center part of the rotary surface of the main body 471. A rotary surface 472*a* of the rubber roller part 472 is given a curve so that it easily follows a concave surface 481*a* of the pressing roller 48, which will be discussed later. In addition, a width t of the rubber roller part 472 is 9 mm in this embodiment, and is set to a dimension that is approximately ¼of the width of the transported strip S, which is 35 mm in this embodiment. A rotatable support shaft 473 is linked to the main body 471, and a pulley, around which the abovementioned drive belt 41*b* is threaded, is attached to the support shaft 473 so that the strip S is rotatably driven in the direction of the feed toward the downstream side of the transport pathway.

The pressing roller 48 is provided and arranged above the drive roller 47, and presses the strip S threaded around the drive roller 47 against the drive roller 47 from above; the frictional force of that pressing prevents the transverse drift of the strip S in the transport pathway, and also functions to improve feed reliability. The rotary surface of a tubularly formed main body 481 of the pressing roller 48 has a concave surface 481*a* corresponding to the rugby ball-shaped convex surface 471*a* of the main body 471 of the drive roller 47. The concave surface 481*a* is manufactured by machining on a lathe.

A gap 46*a* between the drive roller 47 and the pressing roller 48, namely the transverse cross section of the transport pathway of the strip S, is prescribed on the lower side by the convex surface 471*a* and on the upper side by the concave surface 481*a*, and is formed with a curvature that is upwardly convex. Naturally, when the strip S being transported passes the feed roller unit 46, the strip S is also curved so that it follows the direction of the rotary shaft of the rugby ball-shaped rotary surface, and a bend formed upwardly convex is imparted to the strip S. The rubber roller part 472 provided on the rotary surface of the drive roller 47 presses, with a prescribed pressure, against the center part of the concave surface 481*a* of the pressing roller 48 while the rubber roller part 472 is coupled with the pressing roller 48. Accordingly, when passing the feed roller unit 46, the center part of the strip S in the width direction that intersects the transport direction is pressed by the rubber roller part 472 against the concave surface 481*a* of the pressing roller 48. Furthermore, as discussed above, the setting of the rubber roller part 472 to a width narrower than the strip S, and the forming of a curvature in the rotary surface 472*a* of the rubber roller part 472 combine to impart a bend of an appropriate curvature along the centerline in the width direction of the strip S. Support shafts 482 are linked to both ends of the main body 481 of the pressing roller 48, but the support shafts 482 are merely supported so as to be freely rotatable, and the pressing roller 48 is rotated by the drive roller 47, which presses against the pressing roller 48.

Guide Unit 49

As shown in FIG. 4, FIG. 5, and FIG. 7, the guide unit 49 has an upper cutter block 491, a lower cutter block 492, coupling members 493 that couple the cutter blocks 491, 492, a cutter 494, a punch 495, and an air cylinder 496 that drives the cutter 494 and the punch 495. The guide unit 49 is provided and arranged between the strip mounting unit 30 and the feed roller unit 46 in the transport pathway of the strip S. The upper cutter block 491 has a concave part 491*a* that extends on the bottom side thereof in the transport direction of the strip S. The lower cutter block 492 has a convex part 492*a* that extends on the upper side thereof in the transport direction of the strip S. Because the concave part 491*a* and the convex part 492*a* are formed as a block that is partitioned in two, it is comparatively easy to manufacture them by machining. The concave part 491*a* and the convex part 492*a* both have a bent contour curved in a direction that intersects the transport direction of the strip S. Furthermore, when the upper cutter block 491 and the lower cutter block 492 vertically overlap, they form a relationship wherein the convex part 492*a* is accommodated in the concave part 491*a*. Accordingly, when the upper cutter block 491 and the lower cutter block 492 are linked in a state slightly spaced apart, a bent-shaped gap 49*a* having a curved cross section is formed between the upper cutter block 491 and the lower cutter block 492. If this gap 49*a* is established beforehand in the transport pathway of the strip S, then the strip S fed from the feed roller unit 46 passes through the gap 49*a*, which imparts a curved bent shape to the strip S in the transverse cross section that intersects the transport pathway of the strip S. On the surfaces of the lower cutter block 492 and the upper cutter block 491 opposing the drive roller 47, concave parts 491*d*, 492*d* are provided that follow the rotary surface of the drive roller 47, viewed from the side. These concave parts 491*d*, 492*d* are arranged proximate to the drive roller 47. In addition, because the strip S is concavely shaped, the strip S is easily inserted into the guide unit 49. Furthermore, the strip S is fed smoothly because the gap 49*a* is formed in a direction that extends along a tangent to the circumference of the drive roller 47 that feeds the strip S. As shown in FIG. 6, the position of the gap 49*a* matches that of the gap 46*a* of the feed roller unit 46, even in the width direction of the curvature, such that the strip S is fed smoothly from the gap 46*a* to the gap 49*a*.

The upper cutter block 491 and the lower cutter block 492 are linked vertically spaced apart by two pin-shaped coupling members 493 in this embodiment, so that the gap 49*a* is formed with a dimension appropriate to imparting a bend to the strip S between the concave part 491*a* and the convex part 492*a*. A dimension is secured for the gap 49*a* such that the strip S, which vertically passes therethrough, does not get caught midway, and does not easily jam. However, although the coupling members 493 approach the edges of the gap 49*a* in the transverse direction without invading the transport pathway of the strip S, the width dimension of the gap 49*a* in the transverse direction is somewhat tight. Nevertheless, because the concave part 491*a* and the convex part 492*a*, which are formed in the upper and lower surfaces, impart a bend to the strip S in the transverse cross section that intersects the transport direction of the strip S, and because the strip S is maintained rectilinearly, situations like drifting in the transverse direction and getting caught in the coupling members 493, or the strip S getting jammed in the guide unit 49 are avoided. Because the concave part 491*a* forms the upper side of the gap 49*a*, and the convex part 492*a* forms the lower side of the gap 49*a*, the strip S, which passes through the gap 49*a*, follows the upper and lower sides of the gap 49*a*. Accordingly, a bend is imparted with a curvature formed upwardly convex in the transverse cross section that intersects the transport direction.

The lower cutter block 492 has a built-in cutter 494, for forming in the strip S a slit 494*a* in a direction approximately orthogonal to the transport pathway direction of the strip S, and the punch 495, for forming in the strip S a punch hole 495*a* proximate to the slit of the strip S. The cutter 494 and the punch 495 are at the approximate center part of the transverse cross section in the transport pathway of the strip S, and are arranged midway in the transport direction of the strip S in the order of the punch 495 and then the cutter 494, from the upstream side. The cutter 494 is a single blade that extends in a direction approximately orthogonal to the transport pathway, and a tip center part 494*b* thereof protrudes upward. In other words, when the cutter 494 advances and enters the gap 49*a*, it contacts the strip S from the tip center part 494*b* thereof. The punch 495 has a bamboo-like shape in which tubular material is cut diagonally, and a protruding part 495*b* of the tip thereof is positioned at the center part in a direction approximately orthogonal to the transport pathway. Furthermore, slits 491*b*, 491*c* for accepting the tip parts of the cutter 494 and the punch 495 protruding from the lower cutter block 492 are formed on the lower side of the upper cutter block 491 at a position corresponding to the cutter 494 and the punch 495.

Every time a prescribed number of bags B are mounted to the strip S, the cutter 494 and the punch 495 are driven forward by the air cylinder 496 attached to the lower side of the lower cutter block 492. Furthermore, the cutter 494 and the punch 495 extend through the strip S in the gap 49*a* of the guide unit 49 from the side of the convex part 492*a* to the side of the concave part 491*a*, i.e., from the bent concave surface side of the curvature imparted to the strip S to the convex surface side, as shown in FIG. 9, thereby forming the slit 494*a* and the punch hole 495*a* in the strip S.

Because the tip center part 494*b* of the cutter 494 protrudes so that it corresponds to the center part of the strip S in the direction orthogonal to the transport pathway, when forming the slit 494*a* in the strip S, the slit is formed in a direction facing from the vicinity of an apex St of a curved bend imparted in the transverse cross section of the strip S toward the inclined parts Ss on both sides of the apex St. A notch is formed in the cutting part 495*b* of the punch 495, and the scraps of the punch hole 495*a* due to this notch remain without being separated from the strip S. When the scraps separate from the strip S, they accumulate in the gap 49*a* of the guide unit 49 and hinder the operation of the cutter 494 and the punch 495, and it is conceivable that this could cause problems like jamming of the strip S.

Transport Conveyor 80

As shown in FIG. 1, the transport conveyor 80 discharges to the exterior of the bag manufacturing and packaging apparatus 1 bags B that were welded by the strip mounting unit 30 so that their upper end parts line up on the strip S. The transport conveyor 80 operates at a speed matched to the speed at which bags B are manufactured, and feeds the bags B in the left direction of FIG. 1.

Control Unit 90

Figure 8:
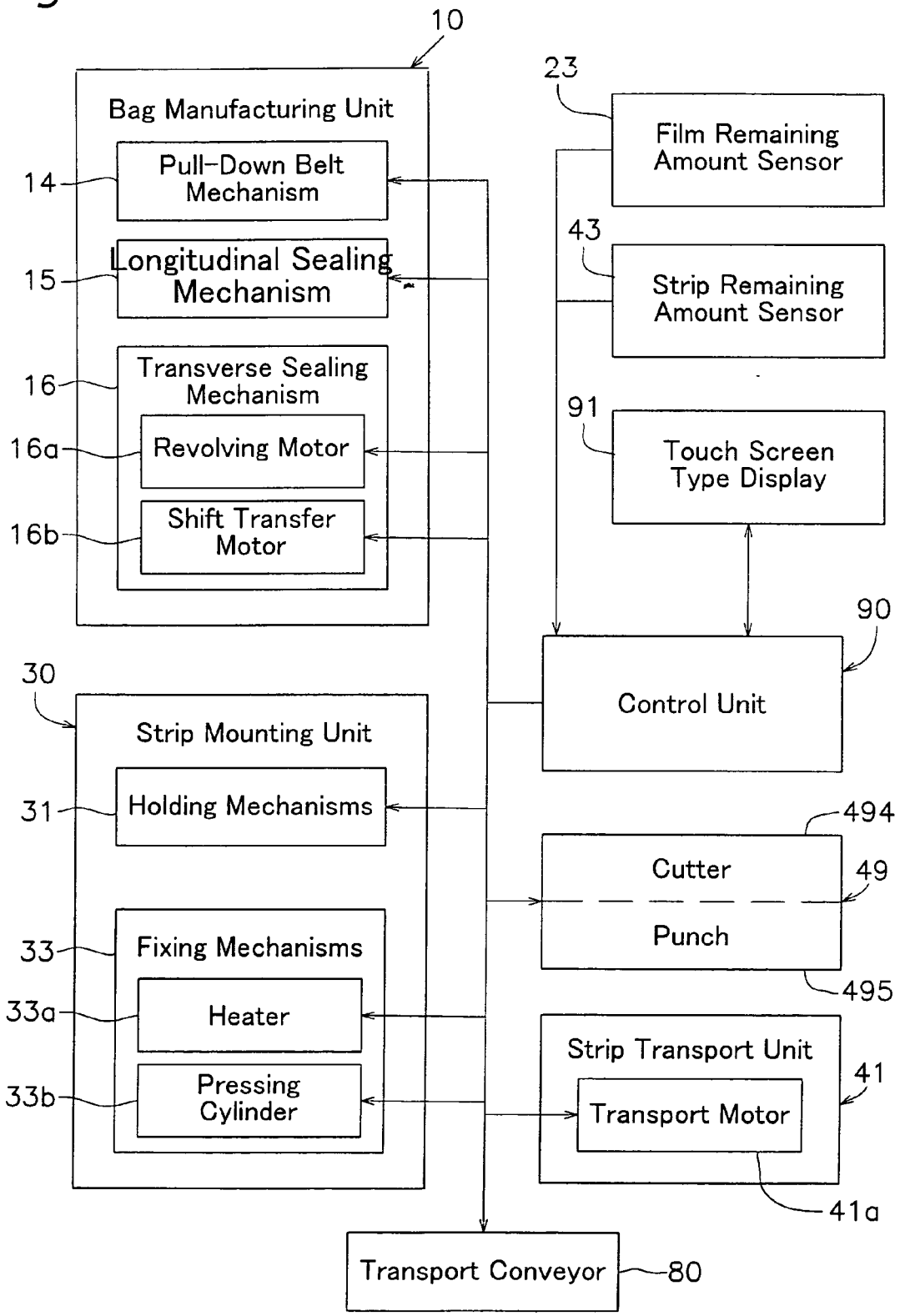
FIG. 8 is a block diagram that depicts the control unit of the bag manufacturing and packaging apparatus according to the embodiment of the present invention.

The control unit 90 preferably includes a microcomputer with a control program that controls various components as discussed below. The control unit 90 can also include other conventional components such as an input interface circuit, an output interface circuit, and storage devices such as a ROM (Read Only Memory) device and a RAM (Random Access Memory) device. The memory circuit stores processing results and control programs that are run by the processor circuit. The control unit 90 is operatively coupled to the bag manufacturing unit 10, the strip mounting unit 30, the film remaining amount sensor 23, the strip remaining amount sensor 43, the display 91, the guide unit 49, and the strip transport unit 41 in a conventional manner as shown in FIG. 8. The control unit 90 is capable of selectively controlling any of the components that are operative connected, in accordance with the control program. It will be apparent to those skilled in the art from this disclosure that the precise structure and algorithms for control unit 90 can be any combination of hardware and software that will carry out the functions of the present invention.

The control unit 90 controls the operation of each of the constituent components according to information input by the operator of the bag manufacturing and packaging apparatus 1 from a touch-screen type display 91 provided and arranged on the side of the bag manufacturing and packaging apparatus 1. Specifically, as shown in FIG. 8, the control unit 90 controls the pull-down belt mechanisms 14, the longitudinal sealing mechanism 15, and the transverse sealing mechanism 16 in the bag manufacturing unit 10; the holding mechanisms 31, the fixing mechanism 33, the strip transport unit 41, the cutter 494, and the punch 495 in the strip mounting unit 30; and the transport conveyor 80; and the like. In addition, information from the film remaining amount sensor 23 and the strip remaining amount sensor 43 is automatically input into the control unit 90.

The information input by the operator via the display 91 is, for example, the quality and thickness of the strip film F used to manufacture bags, the size of the bags B manufactured by the bag manufacturing unit, the number of bags B to be manufactured per unit of time, the weight of the articles to be filled into the manufactured bags B, the selection of whether to mount the bags B to a strip S, the quality and thickness of the strip S, the number of bags B mounted to the strip S, the spacing of the bags B mounted to the strip S, the spacing between groups (each group comprising bags B successively mounted to the strip S), the selection of whether to form slits and punch holes in the strip S, the position where slits and punch holes should be formed in the strip S, and the like.

Based on the information input as mentioned above, the control unit 90 performs control, in the bag manufacturing unit 10, of the operation of forming the strip film F into tubular shape, filling the tubulary formed film with articles, and sealing the sides and upper and lower ends of the tubularly formed film, as follows. First, the tubularly formed film introduced to the forming mechanism 13 is transferred downward by at least a dimension corresponding to the size inputted bag B, and the longitudinal sealing mechanism 15 simultaneously longitudinally seals the strip film F by heating the strip film F to a temperature appropriate for the material of the strip film F. Furthermore, the transverse sealing mechanism 16 transversely seals the strip film F by heating the strip film F to a temperature appropriate for the material of the strip film F, thereby completing the manufacture of the bag B.

In addition, the control unit 90 performs control of the following sequence of operations from holding the bag B manufactured by and discharged downward from the bag manufacturing unit 10, transferring the bag B onto the heater 33*a*, and welding the bag B to the strip S fed onto the heater 33*a*. Immediately before the bag B manufactured by the bag manufacturing unit 10 is discharged downward attendant with the opening of the sealing jaws 51, the holding mechanisms 31, which are transferred below the sealing jaws 51 by the transfer mechanism 32 that is mechanically linked to the sealing jaws 51, are operated and hold the bag B. Further, the bag B held by the holding mechanisms 31 is transferred to the fixing mechanism 33 by mechanical control of the transfer mechanism 32, and the control unit 90 then performs the following control of the fixing mechanism 33. Namely, by controlling the pressing cylinder 33*b*, the pressing body 33*c* is pressed against the heater 33*a*, and the strip S and bag B are interposed between the pressing body 33*c* and the heater 33*a*, such that the strip S and the bag B are attached to one another. To set to an appropriate level of the degree at which the strip S and the bags B are attached, the control unit 90 adjusts the temperature of the heater 33*a* and the pressing force of the pressing body 33*c*, based on information such as the quality and thickness of the strip film F and the strip S.

The control unit 90 controls, in the strip transport unit 41, the rotation of the transport motor 41*a* based on information, such as the number of bags B manufactured per unit of time, the number of bags B mounted to the strip S, the spacing between the bags B mounted to the strip S, and the spacing between groups, with each group having bags B that are successively mounted to the strip S. Because the transport motor 41*a* is a servomotor, the feed rate of the strip S can be accurately controlled based on its pulses. If the feed rate of the strip S is adjusted to a fixed rate, then the spacing of the bags B mounted to the strip S will also be fixed without drifting. Thus, the spacing of the bags B can be set in accordance with the data input beforehand. In addition, because the spacing between groups of bags B is the distance between the rearmost and frontmost bags B of adjacent groups and is larger than the regular spacing between adjacent bags B, control can be performed so that the feed rate of the strip S also is increased when whenthe spacing between groups of bags B is manufacture. Furthermore, in accordance with the feed rate of the strip S, the control unit 90 controls the timing for operating the cutter 494 and the punch 495.

By performing control as mentioned above, bags B are mounted to the strip S, as shown in FIG. 9, and the bags B can be divided into groups of a prescribed number (6 bags B in FIG. 9) by cutting the strip S at the slit 494*a* in the retail store. Furthermore, by hanging the strip S at the punch hole 495*a*, the bags B can be easily displayed in a state wherein a prescribed number of bags B are arranged on the strip S.

The bag manufacturing and packaging apparatus 1 discussed above has the following characteristics due to the bend-imparting unit 45 that includes the feed roller unit 46 and the guide unit 49.

First, the bag manufacturing and packaging apparatus 1 has a characteristic in that the bend-imparting unit 45 rectilinearly maintains the strip S between the feed roller unit 46 and the heater 33*a* of the fixing mechanism 33 of the strip mounting unit 30 by imparting a bend to the strip S in the transverse cross section that intersects the transport pathway of the strip S. By imparting a bend, the modulus of section of the strip S increases, and the bending strength increases in the transport direction. Thereby, the strip S is supplied smoothly, as is, to the strip mounting unit 30 with the strip S being rectilinearly maintained between the feed roller unit 46 and the heater 33*a* without sagging downward, even when using an unrigid strip S formed from a thin resin and when there is no member that fixedly holds the strip S on the downstream side of the feed roller unit 46, as described above. As a result, problems such as jamming of the strip S in the transport pathway of the guide unit 49, which lies between the feed roller unit 46 and the strip mounting unit 30 can be reliably prevented. Also, it is possible to prevent an unevenness in the mounting spacing of the bags B on the strip S due to ununiformity of the feed rate of the strip S in the strip mounting unit 30, and a defect in the position or shape of the slit due to drift of the transport direction of the strip S in the transverse direction. It is further possible to prevent the development of wrinkles in the surface of the strip S due to twisting of the strip S. With the present invention, it is possible to prevent these types of problems without having to use a rigid material like coated paper, to provide a material of a thickness greater than the prescribed thickness, or to make the strip S more rigid. In this manner, a substantial reduction in the cost of the strip S can be achieved.

Secondly, the bag manufacturing and packaging apparatus 1 has a characteristic in that the transverse cross section of the transport pathway in the bend-imparting unit 45 is curvedly formed, and the bend imparted to the transverse cross section of the strip S by the passage of the strip S through the bend-imparting unit 45 is also curvedly formed. Thereby, it is possible to prevent problems such as degrading the appearance of the strip S due to bend marks (folding wrinkles) created by imparting, for example, a V-shaped bend and the like, which impairs product marketability. In addition, the pressing body 33*c* pinching against the heater 33*a* of the fixing mechanism 33 makes the strip S neatly follow the upper end part of the bag B. As a result, it is possible to reliably obtain an appropriate area to which the bags B are attached compared to the case in which there is a strong bending mark like a folding line in the strip S. Therefore problems such as the bag B inadvertently separating from the strip S in the retail store can also be prevented.

Thirdly, the bag manufacturing and packaging apparatus 1 has a characteristic in that the transverse cross section of the transport pathway in the bend-imparting unit 45 is a upwardly convex curve, and is formed so that the curve shape imparted to the transverse cross section of the strip S by the passage of the strip S through the bend-imparting unit 45 is also upwardly convex. As discussed above, because there is no member that fixedly holds the strip S on the downstream side of the feed roller unit 46, the strip S hangs downward on the downstream side of the strip mounting unit 30. Namely, the strip S, which is formed upwardly convex, spreads neatly so that the strip S itself follows the upper surface of the heater 33*a* of the fixing mechanism 33 by the weight of the strip S itself, and smoothly hangs downward downstream of the fixing mechanism 33. Accordingly, there is no concern of wrinkling the strip S. In addition, because the strip S spreads out neatly and is flat on the upper surface of the heater 33*a*, it is easier to attach the bag B that to the strip S. As a result, a stable attaching surface is obtained, thereby reliably preventing such problems as the bag B unexpectedly separating from the strip S.

Fourthly, the bag manufacturing and packaging apparatus 1 has a characteristic in that the transverse cross section of the transport pathway in the feed roller unit 46 that feeds the strip S is curvedly formed as defined by the convex surface 471*a* that is formed on the rotary surface of the main body 471 of the drive roller 47, and the concave surface 481*a* that is formed on the rotary surface of the main body 481 of the pressing roller 48. Thereby, because the feed roller unit 46 imparts a curved bend to the transverse cross section of the strip S, it is not necessary to separately provide and arrange a dedicated part between the feed roller unit 46 and the strip mounting unit 30 for the purpose only of imparting a bend to the strip S. As a result, the manufacturing cost of the bag manufacturing and packaging apparatus 1 itself can be held down, eliminating the time needed to study the competing space requirements of other components.

In addition, because the convex surface 471*a* and the concave surface 481*a*, which define the curved transverse cross section of the transport pathway of the strip S, are formed by the rotary surface of the drive roller 47 and the pressing roller 48, they are comparatively easy to manufacture by using machining equipment like a lathe. As a result, the manufacturing cost of the bag manufacturing and packaging apparatus 1 itself and the number of manufacturing processes can be held down.

Fifthly, the bag manufacturing and packaging apparatus 1 has a characteristic in that the rubber roller part 472 is provided in the center part of the drive roller 47 of the feed roller unit 46, and presses against the center part of the concave surface 481*a* of the pressing roller 48, which mates with the drive roller 47. If there were no rubber roller part 472, the strip S would tend not to stay bent uniformly across its entirety in the gap 46*a* between the drive roller 47 and the pressing roller 48, as shown by S2 in FIG. 6. In contrast, by providing the rubber roller part 472, the strip S is pressed against the center part of the concave surface 481*a* of the rubber roller part 472, and is particularly strongly bent at its center part as shown by S1 in FIG. 6. Therefore, the strip S easily tends to stay bent. In addition, by pressing against the center part of the concave surface 481*a* of the pressing roller 48, the rubber roller part 472 improves the transport force by eliminating a slip between the feed roller unit 46 and the strip S, thereby reliably preventing drift of the strip S in the transverse direction. Meanwhile, because the strip S is merely pressed against by a soft rubber roller, the surface of the strip S is not damaged, and there is no resulting loss in product marketability.

Sixthly, the bag manufacturing and packaging apparatus 1 has a characteristic in that a guide unit 49 is provided and arranged wherethrough the strip S passes between the feed roller unit 46 and the fixing mechanism 33 of the strip mounting unit 30. The transverse cross section of the transport pathway in the guide unit 49 is curvedly formed, and a bend is thereby imparted to the transverse cross section of the strip S. Even if the feed roller unit 46 imparts a bend to the strip S, if the feed roller unit 46 and the strip mounting unit 30 are greatly spaced apart, then the bend imparted to the strip S will unfavorably spread along the way to the strip mounting unit 30 due to the elasticity of the strip S itself, creating a risk that the strip S will unfavorably sag downward. However, if a bend is imparted to the strip S by the guide unit 49 provided and arranged between the feed roller unit 46 and the strip mounting unit 30, then the strip S can be reliably maintained rectilinearly before and after the strip S passes through the guide unit 49. In addition, because the guide unit 49 is disposed in the section of the strip S transport path in which the strip S is unsupported, the length of the transport path in which the strip S is unsupported is therefore short. Furthermore, sagging of the strip mounting unit 30 downward is prevented even if the distance from the feed roller unit 46 to the strip mounting unit 30 is somewhat long.

Seventhly, the bag manufacturing and packaging apparatus 1 has a characteristic in that the cutter 494, which forms slits in the direction approximately orthogonal to the transport direction of the strip S, is provided and arranged at a midway part of the guide unit 49. When the cutter 494 built into the lower cutter block 492 advances, the strip S tries to escape from the cutter 494. However, because the upper cutter block 491, wherein the concave part 491*a* is formed, lies in the direction that the strip S tries to escape, and because the strip S is supported while imparting a bend to the strip S, the strip S is reliably prevented from escaping from the cutter 494. Thereby, appropriate slits can be reliably formed in the strip S.

Furthermore, the bag manufacturing and packaging apparatus 1 has a characteristic in that, because the center part of the cutting part 494*b* of the cutter 494 protrudes in a direction orthogonal to the transport pathway of the strip S, slits are formed in a direction facing from the vicinity of the apex part St of the curved bend imparted to the transverse cross section of the strip S toward the inclined parts Ss on both sides. Thereby, appropriate slits can be more reliably formed without the cutter 494 slipping with respect to the strip S.

Eighthly, the bag manufacturing and packaging apparatus 1 has a characteristic in that the guide unit 49 is formed by the concave part 491*a*, which is formed in the upper cutter block 491 and extends in the transport direction of the strip S, and the lower cutter block 492. The strip S is made to pass through the gap 49*a* between the concave part 491*a* and the convex part 492*a*, which is accommodated in the concave part 491*a*. Because the part through which the strip S passes, formed by the concave part 491*a* and the convex part 492*a*, can be formed by fabricating in combination with the cutter blocks 491, 492, being split into upper and lower parts, the bend formed in the transport pathway can be manufactured easily. As a result, the manufacturing cost of the bag manufacturing and packaging apparatus 1 itself and the number of manufacturing processes can be held down.

Although the embodiment of the present invention has the abovementioned characteristics, the following types of modifications may also be made. In the abovementioned embodiment, the bend imparted to the strip S in the transverse cross section that intersects the transport pathway of the strip S was only a curve shape formed upwardly convex; however, the present invention is not limited thereto. For example, in cases such as where there is no hindrance even if wrinkles and the like remain in the strip S, or where wrinkles and the like do not remain in the strip S or are not conspicuous due to the material of the strip S and the like, it is acceptable to impart a V-shaped or W-shaped fold or a downwardly convex bend to the strip S.

In the abovementioned embodiment, both the feed roller unit 46 and the guide unit 49 were provided as the bend-imparting unit 45, but it would also be acceptable to provide just one or the other. For example, it would be acceptable to use regular cylindrical rollers for the drive roller and the pressing roller that constitute the feed roller unit 46, and to form a bend only in the transverse cross section of the transport pathway in the guide unit 49. Or, it would be acceptable to eliminate the guide unit 49 and just form a bend only in the transverse cross section in the feed roller unit 46.

In the abovementioned embodiment, the drive roller 47 in the feed roller unit 46 is a convex roller, and the pressing roller 48 is a concave roller. However, conversely, it would be acceptable to make the drive roller 47 a concave roller, and the pressing roller 48 a convex roller. In addition, a roller in which the rotary surface was formed in the shape of a rugby ball was used as the convex roller in the above embodiment, but a spherical shape and other shapes would also be acceptable. Combining the drive roller 47 and the pressing roller 48 allows the adoption of other shapes that can impart a bend to the transverse cross section of the strip S.

The abovementioned embodiment explained only the case of forming slits in the strip S in the guide unit 49, but it would also be acceptable to cut the strips and separate them longitudinally. Furthermore, because a bend is imparted to the transverse cross section that intersects the transport direction of the strip S, and the strip S is held rectilinearly extended in the transport direction without sagging downward, feeding the strip S from the feed roller unit 46 enables the tip part of the cut strip S to once again be laid upon the upper surface of the heater 33*a* in the strip mounting unit 30. In this manner, it is possible to create a state in which the bags B can be attached to the strip S without additional personnel. Furthermore, even when initially threading the strip S, feeding the strip S from the feed roller unit 46 enables the tip part of the strip S to ride on the upper surface of the heater 33*a* and the strip mounting unit 30, thus creating a state in which the bags B can be attached to the strip S.

In the abovementioned embodiment, both the upper cutter block 491 and the lower cutter block 492 are coupled by the coupling members 493, and are thereby integrally operated. However, it would also be acceptable to link one side by a hinge and to provide a locking mechanism on the other side. This would enable the easy inspection of the interior if a problem arises inside the guide unit 49.

In the present invention, because the strip is rectilinearly maintained by imparting a bend to the strip in the transverse cross section, the strip is smoothly fed from the feed roller unit to the mounting unit without the strip sagging downward or undulating midway. Thereby, it is possible to prevent problems such as jamming of the strip in the transport pathway of the guide unit and the like, unevenness in the mounting gap of the bags mounted to the strip, defects in the shape of the slits formed in the strip, and wrinkling of the strip.

In addition, because the bend imparted to the strip is curve shaped, either a bend mark is not made in the strip, or a bend mark can be made extremely inconspicuous. In addition, because it is easy for the mounting unit to adhere the attaching surfaces of the bags and the strip, the bags can be reliably mounted.

Furthermore, because the curved shape imparted to the strip is formed upwardly convex, the strip spreads so that it follows the mounting unit due to the weight of the strip itself, and smoothly hangs downward on the downstream side of the mounting unit. Thereby, in addition to preventing wrinkling of the strip, the weld surfaces of the bags and the strip are much more easily adhered, and the bags are therefore more reliably mounted.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The terms of degree such as "substantially", "about" and "approximately" as used herein mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. 2002-320299. The entire disclosure of Japanese Patent Application No. 2002-320299 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A bag manufacturing and packaging apparatus, comprising a bag manufacturing unit that manufactures a bag filled with articles;

a feed roller unit that feeds out a strip with a bend imparted in a transverse cross section of the strip, the strip being narrower than the bag, the transverse cross section intersecting a transport pathway in which the strip is fed out; and a mounting unit that receives the bag from said bag manufacturing unit and the strip fed by said feed roller unit and mounts the bag to the strip, the strip being rectilinearly maintained between said feed roller unit and said mounting unit.

2. The bag manufacturing and packaging apparatus as recited in claim 1, wherein the bend imparted in the transverse cross section of the strip is a curvature.

3. The bag manufacturing and packaging apparatus as recited in claim 1, wherein said bend is formed upwardly convex.

4. The bag manufacturing and packaging apparatus as recited in claim 1, wherein said feed roller unit imparts the bend in the transverse cross section of the strip by forming a transverse cross section of the transport pathway into a bent shape.

5. The bag manufacturing and packaging apparatus as recited in claim 4, wherein said feed roller unit includes a drive roller and a pressing roller that mates said drive roller via their rotary surfaces;

one of the rotary surfaces of said drive roller and said pressing roller has a convex surface; and the other of the rotary surfaces of said drive roller and said pressing roller has a concave surface corresponding to said convex surface.

6. The bag manufacturing and packaging apparatus as recited in claim 5, wherein said one of said drive roller and said pressing roller that has the convex surface has a rubber roller provided in a center part of said convex surface.

7. The bag manufacturing and packaging apparatus as recited claim 1, further comprising a guide unit provided and arranged on the transport pathway of the strip between said feed roller unit and said mounting unit, a transverse cross section of the transport pathway of the strip in said guide unit being formed into a bent shape, such that said guide unit imparts the bend in the transverse cross section of the strip.

8. The bag manufacturing and packaging apparatus as recited in claim 7, wherein said guide unit further includes a cutter provided for forming a slit in the strip in a direction approximately orthogonal to the direction of the transport pathway of the strip.

9. The bag manufacturing and packaging apparatus as recited in claim 8, wherein:

said cutter forms a slit on the strip at a vicinity of an apex of the bend imparted to the transverse cross section of the strip; and said cutter passes through the strip from its concave surface side of the bend to its convex surface side.

10. The bag manufacturing and packaging apparatus as recited in claim 7, wherein said guide unit has a convex part that extends along the transport pathway of the strip, and a concave part that is disposed opposite said convex part and accommodates said convex part; and the strip passes through a gap between said convex part and said concave part.

11. A bag manufacturing and packaging apparatus, comprising:

a bag manufacturing unit that manufactures a bag filled with articles;

a strip mounting unit disposed underneath said bag manufacturing unit for mounting the bag received from said bag manufacturing unit onto a strip; and a strip transport unit disposed adjacent to said strip mounting unit for transporting the strip to said strip mounting unit along a transport pathway, said strip transport unit having a transport motor, a drive roller rotated by said transport motor, and a pressing roller provided above said drive roller for pressing the strip against said drive roller, one of rotary surfaces of said drive roller and said pressing roller having a concave surface, while the other of the rotary surfaces of said drive roller and said pressing roller has a convex surface that corresponds to said concave surface.

12. The bag manufacturing and packaging apparatus as recited in claim 11, wherein said one of said drive roller and pressing roller having said convex surface is approximately rugby ball shaped.

13. The bag manufacturing and packaging apparatus as recited in claim 11, wherein said drive roller has said convex surface.

14. The bag manufacturing and packaging apparatus as recited in claim 11, wherein said one of said drive roller and pressure roller that has said convex surface has a rubber roller provided in a center part of said convex surface.

15. The bag manufacturing and packaging apparatus as recited in claim 11, further comprising a guide unit provided and arranged on the transport pathway of the strip between said strip transport unit and said strip mounting unit, said guide unit having an upper block, and a lower block, one of said upper block and lower block having a convex part, while the other of said upper block and lower block has a concave part, the strip being transported between said convex part and concave part.

16. The bag manufacturing and packaging apparatus as recited in claim 15, wherein said guide unit further includes a cutter provided for forming a slit in the strip in a direction approximately orthogonal to the transport pathway of the strip.

17. The bag manufacturing and packaging apparatus as recited in claim 16, wherein:

said cutter is provided in said one of said upper and lower blocks having said convex part, and said cutter forms a slit on the strip at a vicinity of an apex of said convex part.

18. The bag manufacturing and packaging apparatus as recited in claim 15, wherein:

said lower block has said convex part.

* * * * *